United States Patent [19]

Poisel

[11] Patent Number: 4,485,370

[45] Date of Patent: Nov. 27, 1984

[54] THIN FILM BAR RESISTOR

[75] Inventor: C. Edward Poisel, Indianapolis, Ind.

[73] Assignee: AT&T Technologies, Inc., New York, N.Y.

[21] Appl. No.: 584,966

[22] Filed: Feb. 29, 1984

[51] Int. Cl.[3] ..... H01C 1/012

[52] U.S. Cl. ..... 338/309; 338/195; 338/328; 338/314; 338/323; 219/543

[58] Field of Search ..... 338/195, 307, 308, 309, 338/312, 314, 317, 322, 323, 328, 327, 330; 323/353; 219/203, 522, 543

[56] References Cited

U.S. PATENT DOCUMENTS

| | | | |
|---|---|---|---|
| 3,405,382 | 10/1968 | Wright | 338/323 |
| 3,460,026 | 8/1969 | Dow et al. | 323/353 |
| 3,473,146 | 10/1969 | Mulligan | 338/293 |
| 4,079,349 | 3/1978 | Dorfeld | 338/308 X |

FOREIGN PATENT DOCUMENTS 1367983 9/1974 United Kingdom .

OTHER PUBLICATIONS

*Thin Film Technology,* Berry et al., D. Van Nostrand and Co., 1968.

*Primary Examiner*—Volodymyr Y. Mayewsky
*Attorney, Agent, or Firm*—R. F. Kip, Jr.

[57] ABSTRACT

A thin film bar resistor comprises: an insulative substrate, a pair of conductive thin film resistor terminals spaced apart on the substrate, an approximately square thin film resistance body disposed on the substrate between the terminals to be separated from them by guard margins, the body consisting of lower and upper layers of unanodized and anodized tantalum nitride, thin film regions of unanodized tantalum nitride in the guard margins to connect such body to the terminals, and thin film conductive leads connected to the terminals. The resistance of the resistor is lowered by configuring the leads to be of "L" shape near the terminal so as to define rectangular areas on the substrate bounded by the arms of each "L" and by portions of the body on transversely opposite sides of, and at longitudinally opposite end of the body, and by having supplemental thin film regions in such areas of unanodized tantalum nitride, these supplemental regions constituting electrical bridges between the "L" shaped parts of the leads and such body portions so as to provide current shunts around the terminals and guard margin regions of the resistor. The remaining side edges of the resistor body are recessed slightly inward from the otherwise square outline to allow for error in registration of the anodization mask. The anodization mask is used to apply semi-liquid electrolyte which is used to anodically trim the value of the resistance.

9 Claims, 3 Drawing Figures

THIN FILM BAR RESISTOR

TECHNICAL FIELD

This invention relates generally to resistors and more particularly to resistors comprising an insulative substrate and thin film elements thereon designed to introduce resistance into electric circuits.

BACKGROUND OF THE INVENTION

In numerous applications in the electrical art, the resistance needed in circuits are provided by what has become known as thin film resistors. A thin film resistor comprises an insulative substrate and portions of a thin metallic film (which may be a composite film) deposited on the substrate and designed to provide resistance of a preselected value in an electrical circuit. The thin film is deposited on the substrate by vacuum deposition, evaporation, sputtering or other process, and the film has a thickness which is less than one micron. A "thin film" is to be distinguished from "thick films" which have a separate technology, are usually formed by the deposition of pastes or the like on a substrate and have a thickness exceeding 10 microns.

The disclosure hereof regarding thin films is derived in part from the text *Thin Film Technology* authored by R. W. Berry, P. M. Hall and M. T. Harris and published in 1968 by D. Van Nostrand and Company ("TFT"). Such text and all the references cited therein are incorporated herein by reference.

The thin film elements of thin film resistors are often parts of a much larger thin film pattern produced by well known processes on a substrate to provide thin film integrated circuits each comprising many electric circuit components (such as resistors and capacitors) and conductive leads for coupling the circuit components together. The trend in the manufacture of such integrated circuits has been to miniaturize them insofar as possible in order to realize advantages such as cost and space saving and increased speed of operation of the circuits. The degree however to which such circuits and the electric circuit components thereon can be miniaturized is constrained by limitations in the techniques used to manufacture such circuits. In particular, when a thin film bar resistor is anodized to trim its resistance, size and shape limitations on the smallest mask window usable in the anodizing impose size and shape constraints on the thin film elements of the resistor, and those constraints have, in turn, heretofore limited the minimum resistance obtainable for anodized thin film bar resistors which have been miniaturized insofar as the techniques for manufacturing them will allow. By "an anodized thin film bar resistor" is meant herein a thin film resistor of which the resistance is primarily provided by a rectangular thin film body which has been anodized to trim its resistance.

SUMMARY OF THE INVENTION

Such limitation on the minimum resistance obtainable for anodized thin film bar resistors which have been so miniaturized is overcome according to the present invention in the following manner. A thin film bar resistor with a conventional structure comprises an insulative substrate and thin film elements thereon including a pair of spaced conductive resistor terminals, a rectangular resistance body disposed between the terminals so to be separated from them by guard margins and comprising a lower unanodized layer and an upper anodized layer, unanodized thin film strip regions occupying such margins and electrically coupling the terminals to opposite ends of the resistance body, and a pair of conductive leads respectively connected to the two terminals. That conventional structure thin film bar resistor is improved according to the invention by (a) providing by at least one of such leads a conductive circuit path which is spaced transversely outward on the substrate from a portion of the resistance body which is adjacent to that path and to the terminal to which such lead is connected, and which portion is on one of the transversely opposite sides of the body, and by (b) including in the resistor a supplementary unanodized thin film region deposited on the substrate and integrally joined to that side portion and to a length of such path to form an electrical bridge providing a current shunt around the mentioned terminal and its adjacent strip region. By virtue of the incorporation of such bridge in the bar resistor, its resistance as seen between its two leads is reduced to a value not heretofore obtainable in anodized thin film bar resistors which have been miniaturized as much as their manufacturing techniques will permit. While the invention is particularly applicable to anodized thin film bar resistors of such small size, it is also applicable to resistors of such kind of larger size.

BRIEF DESCRIPTION OF DRAWINGS

For a better understanding of the invention, reference is made to the following description of an exemplary embodiment thereof, and to the accompanying drawings wherein.

DETAILED DESCRIPTION OF EMBODIMENT

Figure 1:
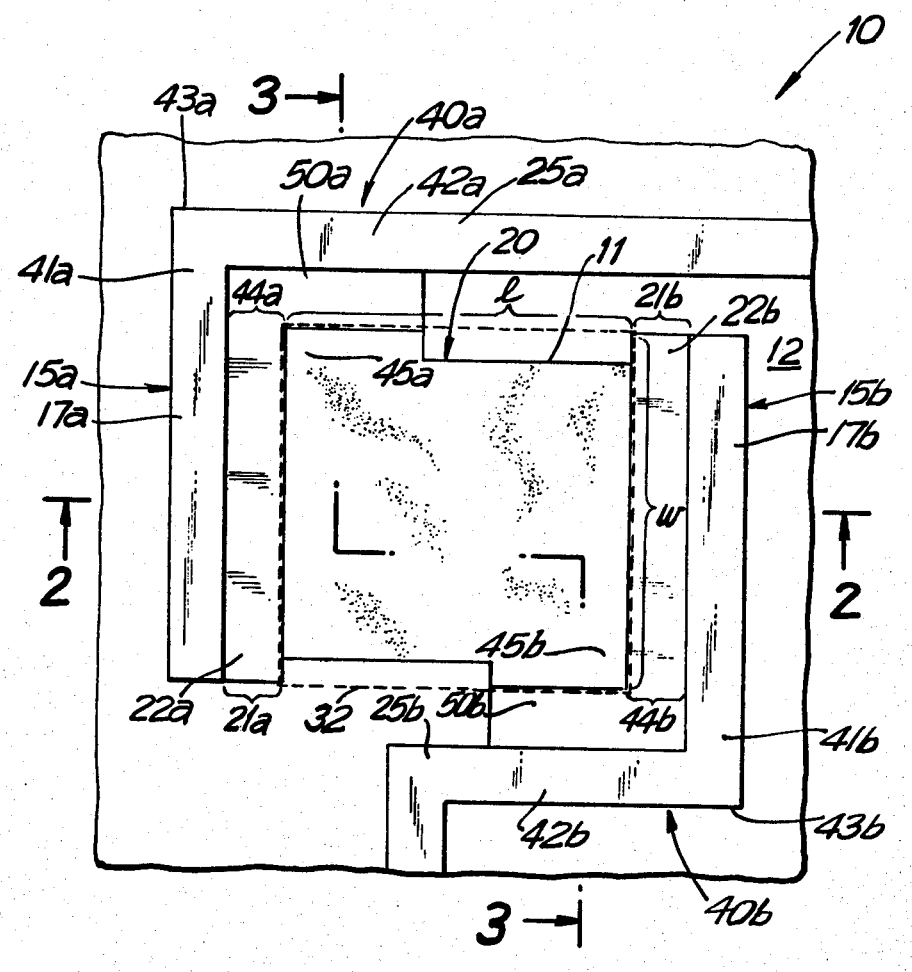
FIG. 1 is a plan view of an exemplary thin film bar resistor according to the invention.

By way of introduction and as explained in "TFT," Section 7-1, a thin film on a substrate has a characteristic $R_s$ which is known as "sheet" resistance, and which is equal to the specific resistivity in centimeter$^3$ of the thin film material, divided by the thickness in centimeter of the film. The sheet resistance $R_s$ can be considered as the resistance offered by one square centimeter of the film to passage of electric current from one side to the other of the square. The characteristic has however a greater significance. When the thin film is in the shape of a rectangular (square or oblong) bar having a length l and a width w, the lengthwise resistance of such bar evidently will be $R_s \times l/w$. The quantity (l/w) is dimensionless (i.e., is a pure number) so that, as a consequence, rectangular thin film regions of the same thinness and of the same material and having the same ratio of length l to width w will have the same lengthwise resistance for any size whatever of those regions. If the width w equals the length l so that the ratio (l/w) equals 1.0, each of those regions will be square in shape, from which it follows that the sheet resistance $R_s$ of the thin film can be considered not only to be a characteristic of the thin film as such (whatever its size or shape) but also the actual lengthwise resistance of a square region of any size provided by the thin film. For this reason, the value of $R_s$ is often expressed as "ohms per square."

An approach used in determining the lengthwise resistance of a rectangular thin film region is to, in effect, divide it into a number of squares of which the sides of each are equal to the width of the region, such width being sometimes referred to as the "line width." Numerically this is done by dividing the length l of the region by its width w to arrive at a number n which represents the number of such squares, and which may be either greater or less than 1.0 in dependence on whether l is greater or less than w. Thus, for purposes of determining its resistance, any such region can be considered as being so many "squares" or a specified fraction of a "square." For example, particular regions may be said to be "2.0 squares" or "0.5 square." In the case of a thin film bar resistor comprising several rectangular regions in series, the number of squares in each such region is computed, and the individual "square" values of those regions are then added to yield a figure which is the value in "squares" of the whole resistor.

It follows from the foregoing that a way of determining the resistance value of a thin film bar resistor is to multiply the sheet resistance value $R_s$ of the included thin film by the value of n which expresses the sum of the number of squares contained in each of the constituent rectangular film regions of the resistor which contribute to its resistance. That is, the resistance of such resistor is the product of an electrical factor, $R_s$ (sheet resistance), and of a geometric factor, n (number of squares), determined by the shape but not by the size of the resistor. Evidently, for any given thin film, the factor $R_s$ will be fixed in value. Accordingly, the only way to reduce the resistance value of any size bar resistor made of such thin film is to reduce the geometric factor n characterizing the resistor or, in other words, the "square" value resulting from the geometry of the resistor. Such square value is reduced as later explained in the thin film bar resistor which is shown in the figures hereof, and which resistor will now be described.

Figure 2:
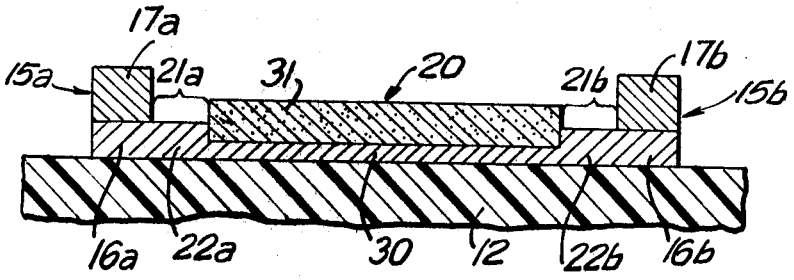
FIG. 2 is a front elevation in cross section, not-to scale, taken as indicated by the arrows 2—2 in FIG. 1, of the FIG. 1 resistor.
Figure 3:
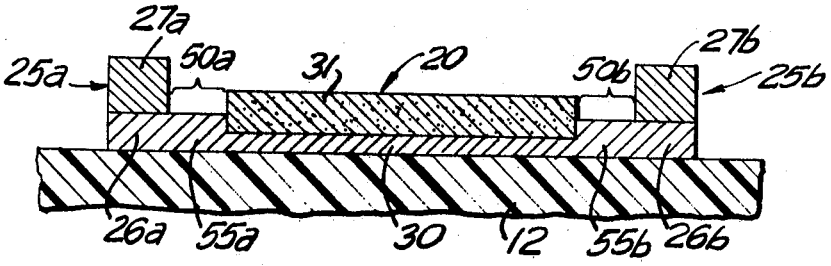
FIG. 3 is a side elevation in cross section, not-to scale, taken as indicated by the arrows 3—3 in FIG. 1, of the FIG. 1 resistor.

Referring to FIGS. 1–3, the reference numeral 10 designates a thin film bar resistor which may be a discrete resistor but which is more likely to be (and is considered herein as being) a part of a larger thin film integrated circuit primarily provided by a pattern formed in a thin film 11 constituted in some places in the pattern of a single film layer and in other places in the pattern of a plurality of thin film layers. Resistor 10 includes an insulative substrate 12 which supports all of the thin film pattern of such circuit but which, for convenience, is shown (FIG. 1) as being broken away so that only the portion of substrate 12 allocable to resistor 10 illustrated. Substrate 12 is preferably a glazed or unglazed alumina substrate.

Substrate 12 supports thereon the elements of thin film 11 which are included in resistor 10. Among those elements are a pair of longitudinally-spaced, transversely-extending resistor terminals 15*a*, 15*b* comprising (a) a pair of transverse strip regions 16*a*, 16*b* (FIG. 2) of valve metal deposited directly on substrate 12 and providing the primary film layer of film 11, and (b) electrically conductive film layer strips 17*a*, 17*b* deposited on regions 16*a*, 16*b* and constituted of a metallic material of much lower resistance than the mentioned valve metal. That is, strips 17*a*, 17*b* render terminals 15*a*, 15*b* electrically conductive in the sense of offering insignificant resistance as compared to the portions of film 11 included in resistor 10 and not overlain by such conductive film layers.

Preferably, the mentioned valve metal is tantalum nitride, and it is to be understood that the term "tantalum nitride" as used herein includes in its meaning oxygen doped tantalum nitride which is frequently referred to as "tantalum oxynitride." If desired, however, the valve metal which provides the primary film layer of film 11 may be one of the other valve metals described in TFT, Section 5.4 and listed in TFT, FIG. 5–8. When the strip regions are 42 ohm per square tantalum nitride on an unglazed alumina substrate, they are about 900 Angstroms thick. The metallic material constituting the conductive film layer strips 17*a*, 17*b* is shown as being a homogenous layer, but in practice such strips are preferably multi-layer structures each comprising a titanium layer about 700 Angstroms thick on the tantalum nitride, a palladium layer about 2000 Angstroms thick on the titanium and a gold layer about 15,000 Angstroms thick on the palladium. Other examples of suitable conductive layer structures are given in TFT, Section 7.4.

Disposed between conductive resistor terminals 15*a*, 15*b* is a rectangular thin film resistance body 20 which is shown in FIG. 1 as being a square body with recesses for pattern registration errors. Body 20 is constituted before anodization of tantalum nitride about 900 Angstroms thick. The opposite longitudinal ends of body 20 are separated from terminals 15*a*, 15*b* by the guard margins 21*a*, 21*b*, the purpose of which is later explained. Such guard margins are occupied by transverse film layer strip regions 22*a*, 22*b* of unanodized tantalum nitride valve metal, about 900 Angstroms thick, which are integrally joined with body 20 and terminals 15*a*, to 15*b* electrically connect the former and latter together.

The terminals 15*a*, 15*b* have connected thereto a pair of conductive leads 25*a*, 25*b* of the same structure as such terminals in that leads 25*a*, 25*b* are constituted (FIG. 3) of underlying film layer regions 26*a*, 26*b* of tantalum nitride valve metal and of overlying conductive film layer strips 27*a*, 27*b* having the same composition as the strips 17 of the terminals 15*a*, 15*b*. Leads 25*a*, 25*b* continue on substrate 12 beyond the places where such substrate is shown broken away (FIG. 1) to connect the thin film bar resistor 10 to other parts of the thin film integrated circuit on such substrate. The leads 25*a*, 25*b* may be considered to be, structurally speaking, extension of the terminals 15*a*, 15*b*.

Returning to resistance body 20, in the manufacture of a thin film integrated circuit, it is a common practice to simultaneously trim the resistance of all the component resistors of such circuit to values preselected for such resistors. Such trimming is done by a process which increases the resistance of such resistors beyond their original resistance value. One such process is anodization which is, as described in TFT, Sections 5.4 and 7.3, accomplished by (a) masking the thin film circuit with a mask having windows registering with the resistance bodies of the resistors of the circuit, (b) introducing a liquid or semi-liquid electrolyte into these windows to make contact with these bodies, and (c) passing electric current through the electrolyte and through such bodies (connected as anodes) to produce an anodizing (i.e., oxidizing) of them. The anodizing progresses from the bodies' top surfaces downward to reduce the thickness of their remaining unanodized metal until the resistance of the resistors has been increased to the value desired therefor, the anodizing current being thereupon discontinued. The foregoing explanation of anodization is highly simplified, and for further details on that technique, reference is made to the Sections of TFT set out above.

FIG. 1 depicts the results on resistor 10 of anodization. As shown in FIGS. 2 and 3, resistance body 20 comprises a lower layer 30 of unanodized tantalum nitride and an upper layer 31 of anodized tantalum nitride which is substantially non-conducting. Layer 30 is about 450 Angstroms thick so as to have a lesser thickness than the adjacent strip regions 22 of unanodized metal of about 900 Angstroms thickness. The (FIG. 1) dash-dash line 32 represents the outline of the window used during anodization to contain the electrolyte and to limit the area covered thereby to approximately that of body 20. Since there may be some spread of the electrolyte in contact with the thin film beyond the area defined by window 32 and there may be errors that occur in the registration of the electrolyte mask, guard margins such as margins 22 must be provided to prevent the electrolyte from reaching one or both of the resistor terminals 15*a*, 15*b* or reaching adjacent conductive leads 25*a*, 25*b*. The reason why such happening must be avoided is that the contact of the electrolyte with those conductive terminals would produce a "short" by-passing resistance body 20, and that body accordingly would not become anodized in response to passage of the mentioned current. In addition, it is necessary to assure complete coverage of the resistor body by providing an electrolyte window slightly larger than the width of the resistor body to allow for error in mask registration.

As so far described, resistor 10 is known to the art.

Coming now to the improvement according to the invention and matters relating thereto, it is often desirable, as has been pointed out, to miniaturize thin film bar resistors such as resistor 10 in order to miniaturize as a whole the integrated thin film circuit in which such resistors are contained and, thereby, to effect cost and space savings and increase the speed of operation of the circuit. Also, it is desirable that the circuit be so designed that the resistances of all its resistors be trimmed proportionally during anodization, and the range of resistor values available to the circuit designer be as great as possible. From the foregoing it follows that for the greatest miniaturization of adjustable resistors using anodization techniques, the resistor body should be contained within the smallest anodization mask window possible with practical manufacturing methods. When using a semi-liquid electrolyte, the smallest size of the width and length that defines the window is the least of such size that surface tension forces characterizing the anodizing electrolyte will not prevent it from passing through the window and contacting the resistance body, and be such that when the mask containing the window is removed, the electrolyte will remain deposited on the resistance body 20. In practice the minimum length and width dimensions of the anodizing window evidently are the same and form a square area. It follows that the smallest length of the body of a bar resistor is equal to the smallest practical anodizing window, and the length between resistor terminals 15*a*, 15*b* is equal to the length of the window 32 plus the guard margins 22*a*, 22*b*. Similarly, the width of the anodizing window together with required guard margins determines the minimum distance between adjacent thin film elements such as conductive leads 25*a*, 25*b* which traverse the lengthwise direction of resistor 10. As previously mentioned, the guard margins are required to prevent the electrolyte from shorting to the adjacent conductors. When, however, the object is to have the minimum resistance possible of the resistor 10 that has been miniaturized, the minimum width dimension required of the window to permit it to pass the electrolyte through it determines the maximum width of the body of a bar resistor and therefore the minimum resistance value attainable for a resistor that has been miniaturized insofar as the techniques for manufacturing them will allow. And as previously mentioned, an allowance in the width of the bar resistor should be provided to assure complete coverage of the resistor body by the electrolyte. This results in a bar resistor width slightly smaller than the width of the electrolyte window by an amount necessary to allow for mask registration errors.

Thus the geometry of resistor 10 as so far described obtains for an anodized thin film bar resistor the minimum resistance heretofore thought possible for a resistor of such kind which has been miniaturized insofar as manufacturing techniques will permit. The geometric factor of such minimum resistance resistor has a value which, taking into account not only the square value for the anodized body 20 but also the square values of unanodized strip regions 22, is about 1.4 square.

Coming now to the improvement according to the invention, conductive lead 25*a* is laid out on substrate 12 (FIG. 1) to provide thereon a first circuit path 40*a* disposed on the substrate to be outward of body 20 in a first of the two opposite directions aligned with the transverse or width dimension of body 20, such first transverse direction being the "upward" direction in FIG. 1. More particularly, circuit path 40*a* is spaced outward in that transverse direction from a side portion 45*a* of body 20 which is adjacent to terminal 15*a* and is on that one of the transversely opposite sides of body 20 which is nearest to such circuit path. As shown, circuit path 40*a* is the form of an "L" having (a) a conductive transverse arm 41*a* integrally joined with and extending outward in the first transverse direction from terminal 15*a*, and (b) a conductive longitudinal arm 42*a* extending from an angular junction 43*a* with arms 41*a* longitudinally past side portion 45*a*. With circuit path 40*a* having such "L" configuration and being so disposed in relation to side portion 45*a*, the result is that arms 41*a*, 42*a* and that side portion bound three sides of a rectangular area 50*a* defined on substrate 12 by those elements, such arms and side portion enclosing the rectangular area 50*a* by a three sided enclosure which is continuous from one end to the other of the enclosure except for a gap 44*a* occurring between the transverse arm 41*a* and the side portion 45*a*.

The description just given of the elements 40*a*–45*a* and 50*a* applies with equal force to their counterpart elements 40*b*–45*b* and 50*b* which are shown in FIG. 1 as being in the lower right hand corner of resistor 10, and which are preferably (but not necessarily) included as parts of the resistor along with elements 40*a*–45*a* and 50*a*. It is to be noted that circuit path 40*b* is spaced from body 20 in the second of the mentioned transverse directions, such second direction being downward in FIG. 1.

Returning to area 50*a*, occupying that area is a thin film region 55*a* (FIGS. 1 and 3) about 900 Angstroms thick of unanodized tantalum nitride valve metal deposited on substrate 12. Region 55*a* (FIG. 3) may conveniently be integrally joined with, and an extension of, guard margin strip region 22*a*, and region 55*a* is, in any event, integrally joined (FIG. 3) with (a) the unanodized tantalum nitride thin film layer 30 underlying the side portion 45*a* (FIG. 1) of body 20 and (b) the unanodized thin film tantalum nitride layer 26*a* (FIG. 3) underlying longitudinal arm 42*a*. Preferably region 55*a* is also integrally joined with the unanodized tantalum nitride thin film layer underlying transverse arm 41*a* to thereby be electrically connected with that conductive arm over its length.

Region 55*a*, 55*b* thus forms an electrical bridge extending between side portion 45*a* and a length of circuit path 40*a* to provide a current shunt for resistor 10 around its terminal 15*a* and its guard margin strip region 22*a*. The presence of that shunt eliminates a significant amount of the resistance of resistor 10 which is seen between its leads and is introduced in part into the resistor by the presence therein of its strip region 22*a*. Thus, the bridge region 55*a* is alone adopted to lower the geometric factor of the resistance of resistor 10 below 1.4 square.

Preferably, however, the resistance lowering effect of bridge region 55*a* is supplemented by providing the matching bridge region 55*b* which further lowers the resistance of resistor 10. While either of regions 55*a*, 55*b* may have any desired longitudinal dimension so long as that region provides a current shunt around its adjacent guard margin strip region, the resistance reducing effect of each of such regions becomes larger with increase in its longitudinal dimension.

With resistor 10 having the geometry shown in FIG. 1 so that each of the side regions 45*a*, 45*b* which bound the bridge regions 55*a*, 55*b* has a length only slightly less than one-half of the entire length of body 20, the geometric factor for the resistance of resistor 10 (as seen between its leads 25*a*, 25*b* is reduced from 1.4 square to 1.18 square or to about 84% of the value which such factor has when resistor 10 is conventional in its geometry. Resistors of the same form factor as shown in FIG. 1 but utilizing only one side termination extending 80% of the length have been produced that yielded 0.9 square. A practical value of approximately 0.6 square can be achieved by the extension of the side terminations on both sides of the resistor body shown in FIG. 1 for 80% of the entire lengths of such sides. Hence, the invention hereof permits a substantial lowering beyond that heretofore thought possible in the resistance of anodized thin film bar resistors which have been miniaturized as much as their manufacturing techniques permit, thus extending the lower range of values available to circuit designers.

As a detail of design of resistor, the length and width dimensions of its body 20 may each conveniently be 1500 microns with the other dimensions of such resistor being to scale in FIG. 1, such dimensions being not limitative of the invention.

The above-described embodiment being exemplary only, it will be appreciated that additions thereto, omissions therefrom and modifications thereof can be made without departing from the spirit of the invention, and that, accordingly, the invention is not to be considered as limited save as is consonant with the recitals of the following claims.

What is claimed is:

1. The improvement in a thin film bar resistor comprising an insulative substrate and thin film elements thereon of which the latter comprise: first and second longitudinally-spaced, transversely-extending conductive resistor terminals, a rectangular resistance body between said terminals and spaced therefrom by guard margins, said body having lower and upper layers of a valve metal which are, respectively, unanodized and anodized, first and second strip regions of said unanodized metal deposited in said margins to connect said first and said second terminals with longitudinally opposite ends of said body, and first and second conductive leads connected to respectively, said first and second terminals; said improvement comprising: a first conductive circuit path provided by said first lead and disposed on said substrate to be spaced outward, in a first of the two transverse directions, from a first portion of said body which is adjacent to said first terminal and is on a first of the transversely opposite sides of said body, and a first supplemental thin film region of said unanodized metal deposited on said substrate in integrally joined relation with such portion and with a length of said path to form on said substrate a first electrical bridge extending between such portion and such length and providing a current shunt around said first terminal and said first strip region.

2. The improvement according to claim 1 in which said first circuit path is in the form of an "L" having a transverse arm integrally joined with and extending outward in said first transverse direction from said first terminal and also, a longitudinal arm extending from its angular junction with said transverse arm longitudinally past said first side portion of said body so that such portion and arms bound three sides of a substantially rectangular area on said substrate, and in which said supplemental thin film region occupies said area to be integrally joined with said first body portion and with both of said arms of said first circuit path.

3. The improvement according to claim 1 in which said rectangular resistance body is a square body.

4. The improvement according to claim 1 in which said valve metal is tantalum nitride.

5. The improvement according to claim 1 in which said first supplemental thin film region of unanodized valve metal is integral with and an extension of said first strip region of unanodized valve metal.

6. The improvement according to claim 1 in which the thickness of metal in said first strip region and in said first supplemental thin film region is greater than the thickness of said lower layer of the resistance body.

7. The improvement according to claim 1 in which the length of said first side portion of said body is less than the entire length of said body and in which said electrical bridge is integral with such side portion over the length thereof.

8. The improvement according to claim 1 further comprising: a second conductive current path provided by said second lead to be spaced outward on said substrate in the second transverse direction from a second portion of said body which is adjacent to said second terminal and is on the second of the transversely opposite sides of said body, and a second supplemental thin film region of said unanodized metal deposited on said substrate between said second path and second side portion in integrally joined relation with such portion and with a length of said second path to form on said substrate a second electrical bridge extending between such portion and length and providing a current shunt around said second terminal and said second strip region.

9. The improvement in a thin film bar resistor comprising an insulative substrate and thin film elements thereon of which the latter comprise: first and second longitudinally-spaced, transversely-extending resistor terminals, a rectangular resistance body between said terminals and spaced therefrom by guard margins, said body having lower and upper layers of respectively, unanodized tantalum nitride and anodized tantalum nitride, first and second strip regions of unanodized tantalum nitride deposited in said margins to connect said first and second terminals with longitudinally opposite ends of said body, and first and second conductive leads connected to, respectively, said first and second terminals; said improvement comprising, first and second circuit paths provided on said substrate by said first and second leads and each in the form of an "L" having a transverse arm and a longitudinal arm, the respective transverse arms of said first and second paths being integrally joined with respectively, said first and second terminals and extending transversely outward thereof in first and second, respectively, of the opposite transverse directions on said substrate, and the respective longitudinal arms of said first and second paths extending in transversely spaced relation from, and longitudinally past, first and second portions of said body which are on transversely opposite sides thereof, and are adjacent to, respectively, said first and second terminals, said first and second side portions of said body and said first and second paths being cooperable to provide bounds on three sides for first and second rectangular areas defined on said substrate and each bounded by one of such side portions and the arms of the current path adjacent that portion, and first and second supplemental thin film regions of unanodized tantalum nitride each occupying a respective one of said first and second areas to be integrally joined with the body's side portion bounding that area and, also, with the said transverse and longitudinal arms which bound that area so as to form on said substrate an electrical bridge extending between such portion and such arms and providing a current shunt around the adjacent terminal and the adjacent strip region, each of said supplemental regions being also integrally joined with and an extension of the adjacent strip region of unanodized tantalum nitride.

* * * * *